United States Patent [19]

Perichon et al.

[11] Patent Number: 4,637,863

[45] Date of Patent: Jan. 20, 1987

[54] PROCESS FOR THE ELECTROSYNTHESIS OF ALCOHOLS AND OF EPOXY COMPOUNDS

[75] Inventors: Jacques Perichon, Savigny Sur Orge; Amélie Rabemanantsoa, Malakoff; Soline Sibille, La Varenne Saint Hilaire; Esther D'Incan, Chatenay Malabry, all of France

[73] Assignee: Societe Nationale des Poudres et Explosifs, Paris, France

[21] Appl. No.: 845,559

[22] Filed: Mar. 28, 1986

[30] Foreign Application Priority Data

Mar. 29, 1985 [FR] France ..... 85 04743

[51] Int. Cl.[4] ..... C25B 3/00

[52] U.S. Cl. ..... 204/59 R; 204/72

[58] Field of Search ..... 204/59 R, 72

[56] References Cited

U.S. PATENT DOCUMENTS

| | | | |
|---|---|---|---|
| 4,468,297 | 8/1984 | Sawyer et al. | 204/59 R |
| 4,517,061 | 5/1985 | Fauvarque et al. | 204/59 R |
| 4,588,484 | 5/1986 | Justice et al. | 204/59 R |

OTHER PUBLICATIONS

"Electrochemical Additions of the Allyl and the Benzyl Groups of Allyl and Benzyl Halides to Acetone", Satoh et al, Bull. Chem. Soc. Jpn., 56, 1791-1794 (1983).

Giuseppe et al., Chem. Abst., 102, (1985) #35188u.

Nonaka et al., Chem. Abst., 94, (1981) #199672.

Karrenbrock et al., Tet. Letters, #17, (1978) pp. 1521-1522.

Shono et al., Tet. Letters, vol. 22 (1981) pp. 871-874.

Shono et al., J. Am. Chem. Soc., 1984, vol. 106, pp. 259-260.

*Primary Examiner*—Arthur P. Demers

*Attorney, Agent, or Firm*—Burns, Doane, Swecker & Mathis

[57] ABSTRACT

The invention relates to a process for the electrosynthesis of alcohols and epoxy compounds by electrochemical reduction of organic halides in the presence of carbonyl derivatives in an organic solvent medium containing a supporting electrolyte. The organic halides contain an atom or a functional group which stabilizes carbon-ions, preferably fixed to the carbon carrying the halogen. The anode is made of a reducing metal preferably chosen from the group consisting of magnesium, aluminium, zinc, iron and their alloys. This process has the advantage of being simple, readily convertible to an industrial scale, especially as a result of the possibility of using a single-compartment cell and low-toxicity solvents. It can be applied to the electrosynthesis of numerous alcohols.

33 Claims, No Drawings

PROCESS FOR THE ELECTROSYNTHESIS OF ALCOHOLS AND OF EPOXY COMPOUNDS

The invention relates to a process for the electrosynthesis of alcohols and of epoxy compounds by electrochemical reduction of organic halides in the presence of carbonyl derivatives, which process is employed in an electrolysis cell in an organic solvent medium containing a supporting electrolyte.

Alcohols are compounds which are widely employed in the chemical industry, especially as synthesis intermediates; they are also used in pharmacy, perfumery, and the like.

Several processes for the electrosynthesis of alcohols by electrochemical reduction of organic halides in the presence of carbonyl derivatives are known:

Shono and co-workers describe such a process in the case of aldehydes as carbonyl derivatives, on the one hand in Tetrahedron Letters, vol 22, pages 871–874 (1981) and, on the other hand, in J. Am. Chem. Soc. 1984, 106, 259–260. The electrolysis cell includes two compartments separated by a ceramic diaphragm, and the electrodes are made of carbon. The aldehyde and the organic halide are introduced into the cathode compartment, in a solvent medium (chloroform or N,N-dimethylformamide).

The reaction is described only in the case of two polyhalides which are particularly easy to reduce ($CCl_4$ and $CCl_3COOCH_3$).

Yields vary from 20 to 89% depending on the products and the operating conditions.

In Tetrahedron Letters, No. 17, pages 1521–1522 (1978), Karrenbrock and Schafer also describe such a process, in which the electrolysis cell includes two separate compartments. The carbonyl derivative and the organic halide are introduced into the cathode compartment, in an N,N-dimethylformamide (DMF) medium as solvent. The reaction is described only for $CCl_4$, a polyhalide which is particularly easy to reduce.

In the case of aldehydes, the yields vary from 30 to 70%.

In the case of ketones the yields are considerably lower (10 to 25%).

In Bull. Chem. Soc. Japan, 56, 1791–1794 (1983), Satoh, Suginome, Tokuda describe the electrosynthesis of tertiary alcohols by electrochemical reduction of allyl or benzyl halides in the presence of acetone in an electrolysis cell without compartments; the electrodes are made of platinum, and the cathode can also consist of mercury or carbon.

Only the use of hexamethylphosphorotriamide (HMPT) as a solvent makes it possible to obtain acceptable yields (13 to 53%, depending on the operating conditions). The use of DMF or of THF as a solvent instead of HMPT is particularly inconvenient since, everything else being equal, the yield then drops from 53% to below 10%.

Now, HMPT is a solvent which is particularly toxic and, in particular, carcinogenic, which rules out its use in an industrial process.

Thus, so far as the Applicant Company is aware, there is no process which is simple and capable of being converted to an industrial scale, for the electrosynthesis of alcohols or of epoxy compounds by electrochemical reduction of organic halides in the presence of carbonyl derivatives, in an electrolysis cell in an organic solvent medium containing a supporting electrolyte, which produces a high yield and which is sufficiently general in application, that is to say capable of being applied, insofar as carbonyl derivatives are concerned, both to aldehydes and to ketones, whose reactivity is known to be lower than that of aldehydes, and capable of being applied to other halogenated derivatives which are more difficult to reduce than the few particularly easily reducible polyhalides mentioned earlier in the state of the art.

The present invention relates to such a process.

The process according to the invention for the electrosynthesis of alcohols and of epoxy compounds by electrochemical reduction of organic halides in the presence of carbonyl derivatives in an electrolysis cell fitted with electrodes, in an organic solvent medium containing a supporting electrolyte, is characterized in that a sacrificial anode is used which is made of a metal chosen from the group of the reducing metals and in that the organic halides contain at least one atom or one functional group which stabilizes carbanions.

It has been found, as the following description demonstrates, that, in a completely unexpected manner, high yields are thus obtained, while:

(1) This process is very simple to use, since it can be used in an electrolysis cell with a single compartment, without any diaphragm or sinter, and this is very important, especially on an industrial scale.

(2) This process can be used with relatively nontoxic solvents which can be used and are commonly used in industry (for example DMF).

(3) This process is relatively wide in scope and can be applied to the electrosynthesis of many alcohols and epoxy compounds.

It should also be noted that, in contrast to the processes described in the state of the art, in which an inert anode is used, no solvent degradation takes place at the anode in the process according to the invention. This specific feature is especially interesting and advantageous.

The electrolysis cell is a conventional cell, well known to the man skilled in the art, and comprises only one compartment.

This possibility of using a single-compartment cell is a major advantage, as already mentioned.

According to the invention, the organic halides contain at least one atom or one functional group which stabilizes carbanions. Preferably, this atom or group is attached to the carbon carrying the halogen, that is to say situated in the $\alpha$-position relative to the halogen.

The atoms and functional groups which stabilize carbanions are well known to the man skilled in the art. For example, halogens and ester, ketone, allyl, benzyl, alkoxy and nitrile groups may be mentioned.

Preferably, the organic halides which can be used within the scope of the present invention correspond to the general formula RX in which X denotes a halogen atom and R denotes a substituted or unsubstituted benzyl group

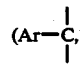

(Ar denoting an aromatic group)

a substituted or unsubstituted allyl group

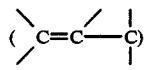

an α-monohalo

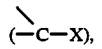

gem-dihalo

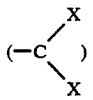

or α-trihalo ($CX_3$) group an α-ester group

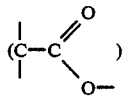

an α-keto group

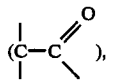

or an aryl group substituted by groups which stabilize carbanions.

By way of illustration, and without implying any limitation, there may be mentioned, for example, benzyl chloride, benzyl bromide, allyl chloride, 3-chloro-2-methylpropene, 3-chloro-1-butene, ethyl 1-chloro-1-methylacetate, carbon tetrachloride, dichlorophenylmethane, 1-phenyl-3-chloropropene and 1-methyl-3-chloropropene.

According to a particular embodiment of the invention, the carbonyl derivatives correspond to the general formula

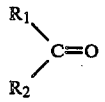

in which $R_1$ and $R_2$, which are identical or different, denote:

a hydrogen atom, a substituted or unsubstituted, saturated or unsaturated, aliphatic or alicyclic chain, a substituted or unsubstituted aryl group, or, alternatively, $R_1$ and $R_2$, form, together with the carbon atom to which they are attached, a saturated or unsaturated, substituted or unsubstituted ring containing, if appropriate, one or more heteroatoms such as nitrogen, oxygen, phosphorus or sulphur. By way of illustration and without implying any limitation, there may be mentioned, for example, acetone, cyclohexanone, methyl ethyl ketone, acetaldehyde, benzophenone and dichlorobenzophenone.

According to a preferred embodiment, the alcohols obtained according to the process which is the subject of the present invention correspond to the general formula

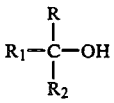

in which R, $R_1$ and $R_2$ have the abovementioned meaning.

In an especially preferred manner, when the carbonyl derivatives are ketones, that is to say when $R_1$ and $R_2$ are other than hydrogen, tertiary alcohols are obtained.

Epoxy compounds are obtained when a gem-dihalogenated compound is used as an organic halide. An elimination of one molecule of a halogenated acid then takes place.

As a general rule, to implement the present invention, it is obvious to the man skilled in the art that the carbonyl derivative must be more difficult to reduce than the organic halide and that none of the substituents carried by $R_1$ and $R_2$ must be more electrophilic than the carbonyl group itself.

The process which is the subject of the present invention is characterized in that a sacrificial anode is used which is made of a metal chosen from the group consisting of the reducing metals.

Preferably, the metal is chosen from the group comprising magnesium, aluminium, zinc, iron and their alloys.

"Their alloys" means any alloy containing at least one of the abovementioned metals, namely magnesium, aluminium, zinc and iron. This anode may be of any shape and, in particular, of any of the conventional shapes of metal electrodes which are well known to the man skilled in the art (twisted wire, flat bar, cylindrical bar, renewable bed, balls, cloth, grid, and the like).

Preferably, a cylindrical bar whose diameter is suitable for the size of the cell is used. For example, for a cell whose total capacity is 45 $cm^3$, the diameter of the bar is of the order of 1 cm.

Before use, the surface of the anode is preferably cleaned, chemically (using dilute HCl for example) or mechanically (using a file or emery cloth, for example) in order, in particular, to remove the metal oxide which is frequently present on the metal surface.

The cathode is any metal such as stainless steel, nickel, platinum, gold, silver or carbon. Preferably, it consists of a grid or a cylindrical plate arranged concentrically around the anode.

The electrodes are supplied with a direct current by means of a stabilized supply.

The organic solvents within the scope of the present invention are all weakly protic solvents which are usually employed in organic electrochemistry. DMF, acetonitrile, tetramethylurea (TMU), tetrahydrofuran (THF) and THF-HMPT mixtures may be mentioned as examples. DMF is preferably used.

Acetone can also be used. In this case, it acts both as a solvent and as a carbonyl derivative.

The supporting electrolytes which are used may be those usually employed in organic electrochemistry. As examples, there may be mentioned salts in which the anion is a halide, a carboxylate, an alcoholate, a perchlorate or a fluoroborate, and the cation a quaternary ammonium, lithium, sodium, potassium, magnesium, zinc or aluminium.

Among these salts, special mention may be made of tetraalkylammonium tetrafluoroborates (for example tetrabutylammonium tetrafluoroborate), tetrabutylammonium perchlorate, tetraalkylammonium halides (for example tetrabutylammonium chloride or tetrabutylammonium iodide), and lithium perchlorate.

Preferably, the concentration of the supporting electrolyte in the organic solvent is between 0.01M and 0.5M.

Also preferably, the concentration of organic halides in the organic solvent is between 0.2M and 2M.

The ratio of the concentration of the carbonyl derivative to the concentration of the organic halide in the organic solvent can have any value. An excess of carbonyl derivative will preferably be used and, in particular a concentration ratio of between 0.5 and 10.

The electrolysis reaction of the invention may be catalyzed by an organometallic complex of transition metals such as, for example, the bipyridyl complexes of metal halides and, more particularly, the 2,2'-bipyridinenickel bromide complex.

The use of such a catalyst is found to be highly advantageous when the alkyl halide is difficult to reduce or when the anhydride is easy to reduce.

The following operating procedure is given by way of example:

The electrolysis is carried out (1) at a temperature which is generally between −20° C. and +30° C., (2) at a cathode current density which preferably varies between 0.1 and 10 A/dm$^2$. The operation is generally carried out at a constant current, but it is also possible to operate at a constant voltage, at a controlled potential, or with variable current and potential, (3) with stirring of the solution, for example by means of a bar magnet, after the solution has been deoxygenated by bubbling an inert gas, for example nitrogen or argon.

After the passage of a quantity of current corresponding to 2 faradays (2×96,500 C) per mole of halogenated derivatives (or, if appropriate, until the latter have been completely converted), the electrolysis is discontinued.

To verify that the halogenated derivatives have been completely converted, an aliquot portion of the solution is withdrawn. After hydrolysis, followed by ether extraction, gas chromatography (GC) is used to verify the absence of the original halogenated derivatives and the formation of the corresponding alcohols. At this stage, determination of the halogenated derivatives which are still present makes it possible to establish the degree of conversion of these halogenated derivatives and the determination of the alcohols to establish the yield of the alcohols formed.

The remainder of the solution is then hydrolyzed (for example using water, ammonium chloride or hydrochloric acid). The alcoholate formed is then converted to the alcohol, which is then extracted by means of conventional methods, using ether, for example.

After evaporation of the extraction solvent and of the volatile products, the crude alcohol is isolated and is identified from its NMR and IR spectra, and its purity is determined by GC. This is then used to determine the reaction yield of the pure alcohol isolated, based on the original organic halide.

The crude alcohol isolated is then purified either by distillation or by separation on a silica column. The pure alcohol isolated in this manner (purity checked by (GC) is identified from its IR and NMR spectra.

The invention is illustrated by the following examples, which are not limiting in nature. To obtain these examples, a conventional electrolysis cell, consisting of two parts, is used.

The upper part, made of glass, is fitted with 5 tubes permitting the delivery and the exit of inert gas, sampling of the solution during the electrolysis, if appropriate, and electrical ducting.

The lower part consists of a stopper, fitted with a seal and screwed onto the glass upper part.

The total capacity of the cell is 45 cm$^3$.

The anode consists of a cylindrical bar, 1 cm in diameter. It is introduced into the cell through the central tube and is thus situated in an approximately axial position relative to the cell. It is immersed in the solution over a length of approximately 2.5 cm. The cathode consists of a cylindrical cloth arranged concentrically around the anode. The "working" surface area of the cathode is of the order of 20 cm$^2$.

The cell is immersed in a thermostat bath controlled at the selected temperature.

The specific operating conditions (nature of the electrodes, of the neutral electrolyte, of the solvent used, the bath temperature, and the like) are additionally specified in each example.

EXAMPLE 1

Synthesis of dimethylbenzylcarbinol

The anode is a cylindrical bar of magnesium, 1 cm in diameter. The cathode is a cylindrical cloth made of nickel sponge and arranged concentrically around the anode. Its apparent surface is 20 cm$^2$.

20 cm$^3$ of anhydrous DMF, 10 cm$^3$ (i.e. 136 mmol) of acetone, 3.29 g (26 mmol) of benzyl chloride and 0.78 g (2 mmol) of tetrabutylammonium tetrafluoroborate are introduced into the cell.

Nitrogen is bubbled through the solution for approximately 15 min and then nitrogen is maintained at atmospheric pressure above the solution.

The solution is stirred by means of a bar magnet and the cell is then immersed in a thermostat bath maintained at −20° C.

The electrodes are supplied with direct current by means of a stabilized supply and a constant current density, equal to 2 A/dm$^2$ on the cathode, is applied.

After the passage of 2 faradays per mole of benzyl chloride, an aliquot portion of the solution is withdrawn. After hydrolysis, followed by either extraction, GC analysis shows that all the benzyl chloride has been converted and that dimethylbenzylcarbinol, of formula

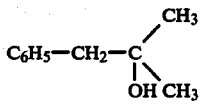

has been formed.

To isolate the alcohol formed from the total solution, excess acetone is first evaporated off and then the solution is hydrolysed with an aqueous solution of ammonium chloride and is extracted 3 times with ether. After the ether and volatile products have been evaporated off, the dimethylbenzylcarbinol is isolated and identified from its NMR and IR spectra. This crude dimethylbenzylcarbinol is 70% pure, as determined by GC. The impurities include bibenzyl, toluene and DMF, and diacetone alcohol.

The crude dimethylbenzylcarbinol isolated is then purified by distillation. Pure dimethylbenzylcarbinol is obtained (purity greater than 95%, according to GC analysis) and is identified from its IR and NMR spectra. The yield of pure dimethylbenzylcarbinol thus obtained is 56%.

EXAMPLES 2 TO 32

Synthesis of dimethylbenzylcarbinol

The tests as those described in Example 1 were carried out, but with modification to some operating conditions, especially the nature of the anode. The operating conditions, compared to those in Example 1, and the results obtained, are given in Table 1. It is found that the yields obtained are relatively high, being between 50 and 70% in most cases. These yields are expressed as the pure alcohol present in the isolated crude alcohol, based on the initial benzyl chloride.

EXAMPLES 33 TO 57

Synthesis of various alcohols

The general operating conditions applied in the preparation, isolation, determinations and purification were the same as in the preceding examples. Information relating to the starting materials and to the specific conditions in each test, and to the results obtained, are given in Table 2.

In Examples 41 and 42 the alcohols formed were isolated from the crude product obtained by chromatographic separation on silica gel and were identified from their IR and NMR spectra.

Unless stated otherwise, the yields shown are those of the alcohols formed, based on the original organic halide.

EXAMPLES 58 TO 65

Preparation of epoxy compounds

By carrying out the electrolysis under the same general conditions of preparation, isolation, determination and purification as those used in the preceding examples, but using a gem-dihalogenated compound as the organic halide, for example benzylidene chloride, the alcohol is obtained but also and merely the epoxy compound by the elimination of a molecule of the acid HX from the alcohol formed.

Table 3 lists the information relating to the starting materials and to the specific conditions in each test, together with the results obtained.

EXAMPLES 66 TO 71

These electrosyntheses were carried out under the same conditions as those in the preceding examples. However, a catalyst was added to the solution, in a proportion of 1.5 mmol.

This catalyst is a 2,2'-bipyridylnickel bromide complex ($NiBr_2Bipy$).

This complex is prepared by adding 2 $10^{-2}$ mole of $NiBr_2.2H_2O$ to 2 $10^{-2}$ mole of 2,2'-bipyridine (Bipy), in 130 ml of absolute ethanol.

This mixture is stirred for 24 hours at a temperature of 20° C. The mixture is filtered to recover the $NiBr_2$.2,2'-Bipy complex which has precipitated.

This precipitate is washed with acetone and, after drying in vacuum at 20° C., 1.8 $10^{-2}$ mole of $NiBr_2Bipy$ is recovered, corresponding to a yield of 90% by weight.

The operating conditions and the identity of the starting materials and of the products obtained in Examples 66 to 71 are collated in Table 4. The yields of the alcohol produced and isolated are expressed on the basis of the carbonyl-containing starting material.

These tests were carried out by starting with an organic halide of formula

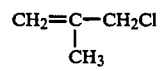

present at a concentration of 35 mmol in 30 ml of DMF, and by using, as a supporting electrolyte, a solution of $N(Bu)_4I$ at a concentration of $10^{-2}$ mole/liter in Tests 66, 67 and 69, or a solution containing $10^{-1}$ mole/liter of $N(Bu)_4Br$ in tests 70 and 71. In Test 68 the neutral electrolyte is $N(Et)_4Br$, at a concentration of $10^{-2}$ mole/liter.

The electrolysis is carried out with a carbon cathode and a current density of 1 A/dm$^2$.

The electrosynthesis process of the invention makes it possible to synthesize compounds which are especially useful in the field of perfumery, such as dimethylbenzylcarbinol, methylethylbenzylcarbinol, for example, or in the field of pharmacy, such as para-chlorobenzyldimethylcarbinol, which is used for the manufacture of chlortermine.

TABLE 1

| Example No | Solvent (cm3) | Electrolyte (mmol) | Anode | Cathode | Temperature (°C.) | Current density at the cathode (A/dm2) | Number of Faradays per mole of benzyl chloride | Yield (%) |
|---|---|---|---|---|---|---|---|---|
| 1 | DMF (20) | $N(Bu)_4BF_4$ (2) | Mg | Ni | −20 | 2 | 2 | 56 |
| 2 | DMF (20) | $N(Bu)_4I$ (2) | Duralumin (Al—Mg alloy) | Ni | −20 | 2 | 2,4 | 75 |
| 3 | DMF (20) | $N(Bu)_4I$ (2) | Zn | Ni | −20 | 2 | 4 | 13 |
| 4 | DMF (20) | $N(Bu)_4BF_4$ (2) | Mg | Stainless steel | −10 | 1,5 | 2 | 56 |
| 5 | DMF (20) | $N(Bu)_4I$ (2) | Mg | carbon fibers | −10 | 2,5 | 2,2 | 70 |
| 6 | DMF (20) | $N(Bu)_4I$ (2) | Mg | Ag | −10 | 2,5 | 2,15 | 48 |
| 7 | DMF | $N(Bu)_4I$ | Duralumin | Ni | −10 | 5 | 2,4 | 52 |

TABLE 1-continued

| Example No | Solvent (cm3) | Electrolyte (mmol) | Anode | Cathode | Temperature (°C.) | Current density at the cathode (A/dm2) | Number of Faradays per mole of benzyl chloride | Yield (%) |
|---|---|---|---|---|---|---|---|---|
| | (20) | (2) | | | | | | |
| 8 | DMF (20) | $N(Bu)_4I$ (2) | Duralumin | carbon fibers | −10 | 2,5 | 3 | 58 |
| 9 | $CH_3CN$ (20) | $N(Bu)_4BF_4$ (2) | Mg | Ni | −10 | 1,5 | 2 | 41 |
| 10 | $CH_3CN$ (20) | $N(Bu)_4I$ (2) | Duralumin | Ni | −10 | 2,5 | 3 | 40 |
| 11 | TMU (20) | $N(Bu)_4I$ (2) | Duralumin | Ni | −10 | 1,25 | 2,8 | 73 |
| 12 | TMU (20) | $N(Bu)_4I$ (2) | Zn | Ni | −10 | 1 | 2,7 | 38 |
| 13 | Acetone[a] (30) | $N(Bu)_4I$ (2) | Duralumin | Ni | −10 | 1,5 | 2,3 | 37 |
| 14[b] | THF (5) HMPT (15) | $N(Bu)_4BF_4$ (2) | Mg | Pt | −10 | 0,15 | 2,2 | 46[c] |
| 15[b] | THF (5) HMPT (15) | $N(Bu)_4BF_4$ (2) | Mg | Ag | −10 | 0,15 | 2,2 | 30 |
| 16[b] | THF (5) HMPT (15) | $N(Bu)_4BF_4$ (2) | Zn | Stainless steel | −10 | 0,75 | 2,2 | 20 |
| 17 | $CH_3CN$ (20) | $N(Bu)_4BF_4$ (5) | Mg | Stainless steel | +20 | 0,5 | 2 | 45 |
| 18[d] | THF (18,8) HMPT (6,2) | $N(Bu)_4BF_4$ (5) | Mg | Stainless steel | +20 | 0,5 | 2 | 50 |
| 19 | THF (18,8) HMPT (6,2) | $N(Bu)_4BF_4$ (5) | Mg | Pt | +20 | 0,5 | 2 | 50 |
| 20 | THF (18,8) HMPT (6,2) | $N(Bu)_4BF_4$ (5) | Mg | Ni | +20 | 1 | 2 | 50 |
| 21 | THF (18,8) HMPT (6,2) | $N(Bu)_4BF_4$ (5) | Mg | Stainless steel | 20 | 1 | 2 | 50 |
| 22 | THF (18,8) HMPT (6,2) | $N(Bu)_4BF_4$ (5) | Mg | Ag | 20 | 1 | 2 | 30 |
| 23 | DMF (20) | $N(Bu)_4BF_4$ (5) | Mg | Stainless steel | 20 | 0,5 | 2 | 60 |
| 24 | DMF (20) | $N(Bu)_4BF_4$ (5) | Zn | Stainless steel | −5 | 0,5 | 3 | 27 |
| 25 | DMF (20) | $N(Bu)_4BF_4$ (5) | Mg | Stainless steel | −5 | 0,5 | 2 | 70 |
| 26 | DMF (20) | $N(Bu)_4BF_4$ (5) | Al | Stainless steel | −5 | 0,5 | 2 | 70 |
| 27 | TMU (20) | $N(Bu)_4BF_4$ (5) | Mg | Stainless steel | −5 | 0,5 | 2 | 70 |
| 28 | TMU (20) | $N(Bu)_4Br$ (5) | Mg | vitreous carbon | −5 | 1 | 2 | 65 |
| 29 | TMU (20) | $LiClO_4$ (5) | Mg | Ni | −5 | 1 | 2,5 | 60 |
| 30[e] | DMF (20) | $N(Bu)_4BF_4$ (5) | Mg | Stainless steel | −5 | 1 | 2 | 65 |
| 31 | acetone[a] (25) DMF (5) | $N(Bu)_4I$ (2) | Mg | Ni | −20 | 2 | 2,2 | 72 |
| 32 | Acetone[a] (25) DMF (5) | $N(Bu)_4I$ (2) | Duralumin | Ni | −20 | 2 | 2,5 | 75 |

[a]Acetone is used both as a solvent and as a carbonyl derivative. The indicated volume is the total quantity of acetone which is used.
[b]6 mmol of benzyl chloride and 10 mmol of acetone.
[c]Yield of the alcohol formed.
[d]13 mmol of benzyl chloride and 68 mmol of acetone.
[e]26 mmol of benzyl bromide instead of 26 mmol of benzyl chloride.

TABLE 2

| Example No | Organic halide (mmol) | Carbonyl derivative (mmol) | Solvent (cm3) | Electrolyte (mmol) | Anode | Cathode | Temperature (°C.) | Current density at the cathode (A/dm2) | Number of Faradays per mole of organic halide | Alcohol formed | Yield (%) |
|---|---|---|---|---|---|---|---|---|---|---|---|
| 33 | 3-chloro 2 methyl propene $CH_2{=}C(CH_3){-}CH_2Cl$ (30) | cyclohexanone (97) | DMF (20) | $N(Bu)_4BF_4$ (2) | Mg | Ni | −20 | 1,25 | 2 | 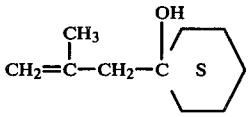 | 20 |
| 34 | 3-chloro 2 methyl propene (30) | acetone (340) | Acetone (25) DMF (5) | $N(Bu)_4I$ (2) | Dura-lumin | Ni | −20 | 2 | 2,5 | 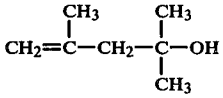 | 95 |
| 35 | 3-chloro 2 methyl propene (30) | benzalde-hyde (150) | DMF (20) | $N(Bu)_4I$ (2) | Al | C | −10 | 2 | 3,5 | 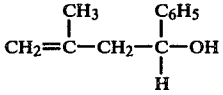 | 70 |
| 36 | 2-chloro ethyl-propionate $Cl{-}CH(CH_3){-}C(=O){-}OC_2H_5$ (30) | acetone (126) | DMF (20) | $N(Bu)_4I$ (2) | Mg | C | −20 | 1,75 | 2 | 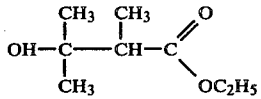 | 35 |
| 37 | 2-chloro ethyl-propionate (30) | acetone (270) | acetone (20) DMF (5) | $N(Bu)_4I$ (2) | Mg | C | −20 | 2 | 2,5 | 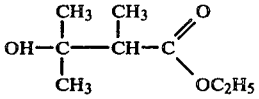 | 42 |
| 38 | $CCl_4$ (30) | acetone (270) | DMF (5) acetone (20) | $N(Bu)_4I$ (2) | Mg | C | −20 | 1 | 2 | 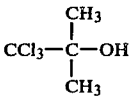 | 45 |
| 39 | $CCl_4$ (30) | acetone (270) | acetone (20) DMF (5) | $N(Bu)_4I$ (2) | Dura-lumin | C | −20 | 1 | 2 | 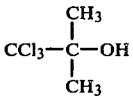 | 40 |
| 40 | $CCl_4$ (30) | Benzaldehyde (130) | DMF (20) | $N(Bu)_4I$ (2) | Mg | C | −10 | 2 | 2 | 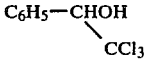 | 60 |

TABLE 2-continued

| Example No | Organic halide (mmol) | Carbonyl derivative (mmol) | Solvent (cm3) | Electrolyte (mmol) | Anode | Cathode | Temperature (°C.) | Current density at the cathode (A/dm2) | Number of Faradays per mole of organic halide | Alcohol formed | Yield (%) |
|---|---|---|---|---|---|---|---|---|---|---|---|
| 41 | 3-chloro 1 methyl propene<br>$CH_3-CH=CH-CH_2Cl$<br>(26) | acetone (270) | acetone (20)<br>DMF (5) | $N(Bu)_4I$ (2) | Duralumin | Ni | −10 | 2 | 2,4 | $CH_3-CH=CH-CH_2-C(CH_3)_2-OH$<br>$CH_2=CH-CH(CH_3)-C(CH_3)_2-OH$ | cis: 11<br>trans: 20<br>68 |
| 42 | 3-chloro 1 butene (32)<br>$CH_2=CH-CH(Cl)-CH_3$ | acetone (340) | acetone (25)<br>DMF (5) | $N(Bu)_4I$ (2) | Duralumin | Ni | −10 | 2 | 2,2 | $CH_2=CH-CH(CH_3)-C(CH_3)_2-OH$<br>$CH_3-CH=CH-CH_2-C(CH_3)_2-OH$ | 53<br>cis: 12<br>trans: 34 |
| 43 | benzyl chloride $C_6H_5CH_2Cl$ (95) | methylethylketone (695) | DMF (105) | $N(Bu)_4BF_4$ (6) | Mg | Stainless steel | +6 | 2 | 2,2 | $C_6H_5-CH_2-C(CH_3)(C_2H_5)-OH$ | 50(a) |
| 44 | 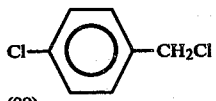 <br>(90) | acetone (810) | DMF (100) | $N(Bu)_4I$ | Mg | Ni | +6 | 2 | 2,2 | 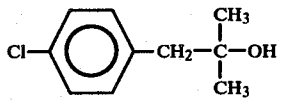 | 48(a) |
| 45 | $C_6H_5-CH_2Cl$ (30) | $CH_3(CH_2)_6-C(=O)-H$ (30) | DMF (27) | $N(Et)_4Br$ (2) | Mg | Ni | −10 | 1 | 2,2 | $C_6H_5-CH_2-CH(OH)-(CH_2)_6-CH_3$ | 60(a) |
| 46 | 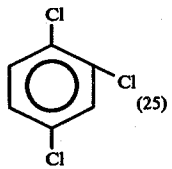 <br>(25) | $CH_3-CO-CH_3$ (28) | DMF (5) | $N(Et)ClO_4$ (2) | Mg | Ni | −10 | 2 | 2,2 | 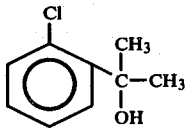 | 50(a) |

TABLE 2-continued

| Example No | Organic halide (mmol) | Carbonyl derivative (mmol) | Solvent (cm3) | Electrolyte (mmol) | Anode | Cathode | Temperature (°C.) | Current density at the cathode (A/dm2) | Number of Faradays per mole of organic halide | Alcohol formed | Yield (%) |
|---|---|---|---|---|---|---|---|---|---|---|---|
| 47 | 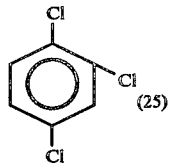 (25) | $CH_3-CO-CH_3$ (25) | DMF (5) | $N(Bu)_4I$ (2) | Al | Ni | −10 | 2 | 2,5 | " | 60(a) |
| 48 | $CCl_4$ (25) | $CH_3-(CH_2)_6-C(=O)-H$ | DMF (30) | $N(Bu)_4I$ (2) | Zn | Ni | −10 | 1,5 | 2,2 | $CH_3-(CH_2)_6-C(OH)-CCl_3$ | 75(a) |
| 49 | $CCl_4$ (50) | 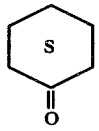 (50) | DMF (25) | $N(Bu)_4I$ (2) | Zn | Ni | −10 | 1,5 | 3 | 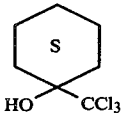 | 20(a) |
| 50 | $CCl_4$ (50) | 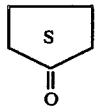 (100) | DMF (20) | $N(Bu)_4I$ (2) | Zn | Ni | −10 | 2 | 3 | 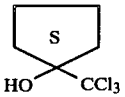 | 45(a) |
| 51 | $CCl_4$ (50) | $C_6H_5-C(=O)-H$ | DMF (20) | $N(Bu)_4I$ (2) | Zn | Ni | −10 | 2 | 2,2 | $C_6H_5-C(OH)-CCl_3$ | 80(a) |
| 52 | $CCl_4$ (50) | $CH_3COCH_3$ (25 ml) | DMF (5) | $N(Bu)_4I$ (2) | Zn | Ni | −10 | 2 | 2,2 | $C_6H_5-C(OH)-CCl_3$ | 80(a) |
| 53 | $CF_3Br$ (p = 1atm) | $C_6H_5-C(=O)-H$ (30) | DMF (5) | $N(Bu)_4I$ (2) | Zn | Ni | −10 | 3 | 2,3 | $C_6H_5-CH(OH)-CF_3$ | 100(a) |

TABLE 2-continued

| Example No | Organic halide (mmol) | Carbonyl derivative (mmol) | Solvent (cm3) | Electrolyte (mmol) | Anode | Cathode | Temperature (°C.) | Current density at the cathode (A/dm2) | Number of Faradays per mole of organic halide | Alcohol formed | Yield (%) |
|---|---|---|---|---|---|---|---|---|---|---|---|
| 54 | $CF_3Br$ (p = latm) | $CH_3-(CH_2)_6-CHO$ (30) | DMF (30) | $N(Bu)_4I$ (2) | Zn | Ni | −10 | 2 | 3 | $CH_3-(CH_2)_6-CH(OH)-CF_3$ | 70(a) |
| 55 | $ClCH_2COCH_3$ (25 to 50) | $CH_3COCH_3$ 25 | DMF (5) | $N(Bu)_4I$ (2) | Zn | Ni or stainless steel | −5 | 1 to 2 | 2,5 | $CH_3-C(CH_3)(OH)-CH_2-CO_2CH_3$ | 30(a) |
| 56 | $CCl_4$ (50) | $(CH_3)_2C=O$ (25 ml) | DMF (5) | $N(Bu)_4I$ (2) | Fe | Ni | −10 | 2 | 2,5 | $(CH_3)_2C(OH)CCl_3$ | 40(a) |
| 57 | $CCl_4$ (50) | $C_6H_5-C(=O)H$ (60) | DMF (5) | $N(Bu)_4I$ (2) | Fe | Ni | −10 | 2 | 2,5 | $C_6H_5-CH(OH)CCl_3$ | 60(a) |

(a)Yield of isolated pure alcohol relative to the initial organic halide.

TABLE 3

| Example No | Organic halide (mmol) | Carbonyl derivative (mmol) | Solvent (cm3) | Electrolyte (mmol) | Anode | Cathode | Temperature (°C.) | Current density at the cathode (A/dm2) | Number of Faradays per mole of organic halide | Compounds formed | Yield (%) |
|---|---|---|---|---|---|---|---|---|---|---|---|
| 58 | benzylidene chloride | acetone (126) | DMF (20) | $N(Bu)_4I$ (2) | Duralumin | Ni | −20 | 1.5 | 2.2 | $C_6H_5-CHCl-C(CH_3)_2-OH$ | 33[a] |
| | $C_6H_5CHCl_2$ (23) | | | | | | | | | 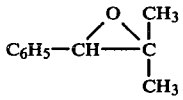 | 50[a] |
| 59 | benzylidene chloride | acetone (126) | DMF (20) | $N(Bu)_4I$ (2) | Duralumin | Ni | −20 | 5 | 2.2 | $C_6H_5-CHCl-C(CH_3)_2-OH$ | 26[a] |
| | $C_6H_5-CHCl_2$ (23) | | | | | | | | | 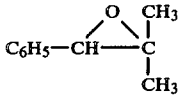 | 40[a] |
| 60 | benzylidene chloride | acetone (126) | DMF (20) | $N(Bu)_4I$ (2) | Mg | Ni | −20 | 2 | 2.9 | $C_6H_5-CHCl-C(CH_3)_2-OH$ | 3[a] |
| | $C_6H_5-CHCl_2$ (23) | | | | | | | | | 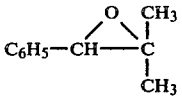 | 50[a] |
| 61 | benzylidene chloride | acetone (126) | DMF (20) | $N(Bu)_4I$ (2) | Mg | Ni | −20 | 5 | 3.1 | $C_6H_5-CHCl-C(CH_3)_2-OH$ | 4[a] |
| | $C_6H_5-CHCl_2$ (23) | | | | | | | | | 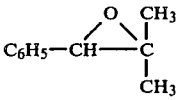 | 52[a] |
| 62 | benzylidene chloride (23) | acetone (270) | acetone (20) DMF (5) | $N(Bu)_4I$ (2) | Duralumin | Ni | −20 | 5 | 2.2 | $C_6H_5CHCl-C(CH_3)_2-OH$ | 37[a] 53[a] [b] |

TABLE 3-continued

| Example No | Organic halide (mmol) | Carbonyl derivative (mmol) | Solvent (cm3) | Electrolyte (mmol) | Anode | Cathode | Temperature (°C.) | Current density at the cathode (A/dm2) | Number of Faradays per mole of organic halide | Compounds formed | Yield (%) |
|---|---|---|---|---|---|---|---|---|---|---|---|
| 63 | benzylidene chloride (30) | acetone (340) | acetone (25) DMF (5) | $N(Bu)_4I$ (2) | Mg | Ni | −20 | 2 | 2.5 | $C_6H_5CHCl-C(CH_3)_2-OH$ | 10[a] 50[b] |
| 64 | 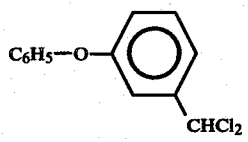 | acetone | acetone (70) DMF (20) | $N(Bu)_4I$ (2) | Mg | Ni | 0 | 2 | 2.3 | 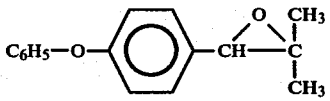 | 42[a] |
| 65 | $Cl_2CH-CO_2CH_3$ (25) | $C_6H_5-CHO$ (60) | DMF (20) | $N(Bu)_4I$ (2) | Zn | Ni | −5 | 1 to 2 | 2.5 | 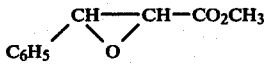 | 24[a] |
| | | | | | | | | | | $C_6H_5-CH(OH)-CH(Cl)-CO_2CH_3$ | 26[a] |

[a]Yield of separate product with respect to the initial organic halide.
[b]Yield of separate epoxide.

TABLE 4

| Example No | Carbonyl derivative (mmol) | Anode | Temperature (°C.) | Number of Faradays per mole of organic halide | Alcohol formed | Yield % |
|---|---|---|---|---|---|---|
| 66 | $C_6H_5-\overset{O}{\overset{\|\|}{C}}-CH_3$ (22) | Zn | 20 | 2.1 | $CH_2=C-\overset{OH}{\overset{\|}{C}}-C_6H_5$ ($CH_3$) | 95 |
| 67 | $C_6H_5-CHO$ (20) | Zn | 20 | 2.1 | $CH_2=\overset{CH_3}{\overset{\|}{C}}-CH_2-\overset{OH}{\overset{\|}{C}}-C_6H_5$ ($CH_3$) | 86 |
| 68 | $CH_3-(CH_2)_6-CHO$ (20) | Zn | 20 | 2.1 | $CH_2=\overset{CH_3}{\overset{\|}{C}}-CH_2-\overset{OH}{\overset{\|}{C}H}-(CH_2)_6-CH_3$ | 85 |
| 69 | 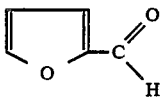 (30) | Zn | 20 | 2.2 | 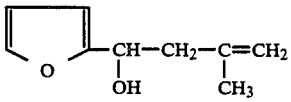 | 50 |
| 70 | 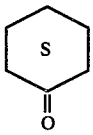 (30) | Mg | 50 | 2.1 | 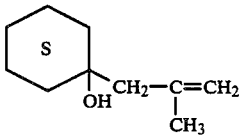 | 45 |
| 71 | 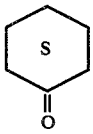 (30) | Zn | 20 | 2.1 | 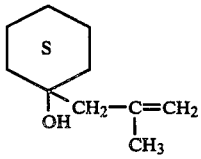 | 70 |

We claim:

1. Process for the electrosynthesis of alcohols by electrochemical reduction of organic halides in the presence of carbonyl derivatives in an electrolysis cell fitted with electrodes in an organic solvent medium containing a supporting electrolyte, comprising using a sacrifical anode made of a metal chosen from the group of the reducing metals and wherein said organic halides contain at least one atom or one functional group which stabilizes carbanions.

2. Process for the electrosynthesis of alcohols according to claim 1, wherein said sacrifical anode is made of a metal chosen from the group consisting of magnesium, aluminium, zinc, iron and alloys thereof.

3. Process for the electrosynthesis of alcohols according to claim 1, wherein said atom or said functional group which stabilizes carbanions is attached to the carbon carrying the halogen.

4. Process for the electrosynthesis of alcohols according to claim 1, wherein said carbonyl derivatives correspond to the general formula

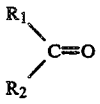

in which $R_1$ and $R_2$, which are identical or different, denote a hydrogen atom;

a substituted or unsubstituted, saturated or unsaturated, aliphatic or alicyclic chain;

a substituted or unsubstituted aryl group; or, alternatively, $R_1$ and $R_2$ form, together with the carbon atom to which they are attached, a saturated or unsaturated, substituted or unsubstituted ring.

5. Process for the electrosynthesis of tertiary alcohols according to claim 1, wherein said carbonyl derivatives are ketones.

6. Process for the electrosynthesis of alcohols according claim 1, wherein said organic halides correspond to the general formula RX, in which X denotes a halogen atom and R denotes:

a substituted or unsubstituted benzyl group;

a substituted or unsubstituted allyl group;

an α-monohalogenated, α-dihalogenated or α-trihalogenated group;

an α-ester group;

an α-ketone group; or an aryl group substituted by groups which stabilize carbanions.

7. Process for the electrosynthesis of alcohols according to claim 1, wherein said organic solvent is N,N-dimethylformamide.

8. Process for the electrosynthesis of alcohols according to claim 1, wherein said supporting electrolyte is chosen from the group consisting of tetraalkylammonium tetrafluoroborates, tetraalkylammonium halides, tetrabutylammonium perchlorate and lithium perchlorate.

9. Process for the electrosynthesis of alcohols according to claim 1, wherein the concentration of said supporting electrolyte in said organic solvent is between 0.01M and 0.5M.

10. Process for the electrosynthesis of alcohols according to claim 1, wherein the concentration of said organic halides in said organic solvent is between 0.2M and 2M.

11. Process for the electrosynthesis of alcohols according to claim 1, wherein the ratio of the concentration of said carbonyl derivative to the concentration of said organic halide in said organic solvent is between 0.5 and 10.

12. Process for the electrosynthesis of alcohols according to claim 1, wherein the temperature of electrolysis is between −20° C. and +30° C.

13. Process for the electrosynthesis of alcohols according to claim 1, wherein the cathode current density is between 0.1 $A/dm^2$ and 10 $A/dm^2$.

14. Process for the electrosynthesis of alcohols according to claim 1, wherein the electrolysis is carried out at constant current.

15. Electrosynthesis process according to claim 1, wherein the electrolysis is carried out in the presence of a catalyst chosen from the organometallic complexes of transition metals.

16. Electrosynthesis process according to claim 15, wherein said catalyst is the bipyridylnickel bromide complex.

17. Process for the electrosynthesis of alcohol according to claim 15, wherein said catalyst is selected from the group consisting of bipyridyl complexes of transition metal halides.

18. Process for the electrosynthesis of alcohol according to claim 4, wherein $R_1$ and $R_2$ form, together with the carbon atom to which they are attached, a saturated or unsaturated, substituted or unsubstituted ring, and said ring contains one or more heteroatoms.

19. Process for the electrosynthesis of epoxy compounds by electrochemical reduction of organic halides in the presence of carbonyl derivatives in an electrolysis cell fitted with electrodes in an organic solvent medium containing a supporting electroyte, comprising using a sacrificial anode made of a metal chosen from the group of reducing metals and wherein said organic halide is chosen from the group of gem-dihalogenated compounds.

20. Electrosynthesis process according to claim 19, wherein the electrolysis is carried out in the presence of a catalyst chosen from the organometallic complexes of transition metals.

21. Electrosynthesis process according to claim 19, wheein said catalyst is the bipyridylnickel bromide complex.

22. Process for the electrosynthesis of epoxy compounds according to claim 20, wherein said catalyst is selected from the group consisting of bipyridyl complexes of transition metal halides.

23. Process for the electrosynthesis of epoxy compounds according to claim 19, wherein said sacrificial anode is made of a metal chosen from the group consisting of magnesium, aluminium, zinc, iron and alloys thereof.

24. Process for the electrosynthesis of epoxy compounds according to claim 19, wherein said atom or said functional group which stabilizes carbanions is attached to the carbon carrying the halogen.

25. Process for, the electrosynthesis of epoxy compounds according to claim 19, wherein said carbonyl derivatives correspond to the general formula

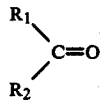

in which $R_1$ and $R_2$, which are identical or different, denote

- a hydrogen atom;
- a substituted or unsubstituted, saturated or unsaturated, aliphatic or alicyclic chain;
- a substituted or unsubstituted aryl group; or, alternatively, $R_1$ and $R_2$ form, together with the carbon atom to which they are attached, a saturated or unsaturated, substituted or unsubstituted ring.

26. Process for the electrosynthesis of epoxy compounds according to claim 19, wherein said organic solvent is N,N-dimethylformamide.

27. Process for the electrosynthesis of epoxy compounds according to claim 19, wherein said supporting electrolyte is chosen from the group consisting of tetraalkylammonium tetrafluoroborates, tetraalkylammonium halides, tetrabutylammonium perchlorate and lithium perchlorate.

28. Process for the electrosynthesis of epoxy compounds according to claim 19, wherein the concentration of said supporting electrolyte in said organic solvent is between 0.01M and 0.5M.

29. Process for the electrosynthesis of epoxy compounds according to claim 19, wherein the concentration of said organic halides in said organic solvent is between 0.2M and 2M.

30. Process for the electrosynthesis of epoxy compounds according to claim 19, wherein the ratio of the concentration of said carbonyl derivative to the concentration of said organic halide in the organic solvent is between 0.5 and 10.

31. Process for the electrosynthesis of epoxy compounds according to claim 19, wherein the temperature of electrolysis is between −20° C. and +30° C.

32. Process for the electrosynthesis of epoxy compounds according to claim 19, wherein the cathode current density is between 0.1 $A/dm^2$ and 10 $A/dm^2$.

33. Process for the electrosynthesis of alcohols according to claim 19, wherein the electrolysis is carried out at constant current.

* * * * *